US005631878A

United States Patent [19]

Chen

[11] Patent Number: 5,631,878

[45] Date of Patent: May 20, 1997

[54] TIME EQUIPMENT

[76] Inventor: Eddie Z. Chen, 17411 Seco Ct., Rowland Heights, Calif. 91748

[21] Appl. No.: 533,777

[22] Filed: Sep. 26, 1995

[51] Int. Cl.[6] ..... G04B 19/22

[52] U.S. Cl. ..... 368/21; 368/27

[58] Field of Search ..... 368/21–27

[56] References Cited

U.S. PATENT DOCUMENTS

| | | | |
|---|---|---|---|
| 557,173 | 3/1896 | Thompson | 368/27 |
| 1,513,317 | 10/1924 | Frakes | 368/27 |
| 3,115,002 | 12/1963 | Beresford | 368/27 |
| 4,032,754 | 6/1977 | Ageton | 368/23 |
| 5,220,539 | 6/1993 | McDuffee | 368/28 |

*Primary Examiner*—Bernard Roskoski

*Attorney, Agent, or Firm*—David & Raymond; Raymond Y. Chan

[57] ABSTRACT

A time equipment includes a case, a dial, and an hour and a minute indicating hands mounted for rotating above the dial. A movement is installed in the case for driving the hour indicating hand to rotate one revolution in 24 hours. A time setting device is installed in the case for setting the time equipment on time. The dial has an hour portion, a minute portion and a period portion, in which the hour portion inscribes two sequences of numerals ordered by increasing value from 1 to 12. The minute portion is positioned adjacent to the hour portion and inscribes a sequence of numerals ordered by increasing value from 1 to 60. The period portion is position at the central area and encircled by the hour portion, which has a central cross inscription having a vertical line extending from top to bottom and a horizontal line extending from right to left so as to divide said period portion into four sections. An alarm generating mechanism can provide more than one alarm signal at predetermined time. An alarm time setting assembly is installed in the case for setting the predetermined alarm time. A switch device is installed in the case for stopping the alarm signal when generating. Therefore, the time equipment enables more than one alarm time setting in 24 hours, enables the users to observe at one time an exact time indicating hours, minutes, seconds, day or night, am or pm, and various time periods in form of morning, afternoon, evening, and night, and can simultaneously indicate the time for a plurality of times zones.

14 Claims, 10 Drawing Sheets

TIME EQUIPMENT

BACKGROUND OF THE INVENTION

The present invention relates to a timepiece, and more particularly to a time equipment which can provide precise and easy read time observation of hours, minutes, seconds, day or night, a.m. or p.m., and time period in form of morning, afternoon, evening, or night at one time, so that it can be equipped with a time zone means for simultaneously indicating the time for at least two time zones, and/or be equipped with an alarm mechanism for enabling more than one alarm time setting in 24 hours.

A conventional timepiece, constructed in the form of a watch or a clock, comprises a movement, a dial, an hour indicating hand, a minute indicating hand, a second indicating hand, a time setting mechanism for the hands, and a driving means. The indicating hands are mounted for rotating above the dial. The driving means connects the indicating hands to the movement for rotating the hands so as to indicate the time over 12 hours.

Since the dial of the conventional time piece as described above has only numerals of 1 to 12 equally spaced apart with each other, inscribed on the periphery thereof, one can not determine that the indicated time is a day time or a night time simply from the 12-hour dial of the timepiece. For example, if the indicated time on the 12-hour dial is seven-thirty o'clock, one cannot determine that it is 7:30 am or 7:30 pm without a further observation of the outdoor circumstances. Thus, for people in an indoor area, such as a surgery doctor in a surgical room, a tourist in a casino, an engineer in subway, a worker in an air conditioning factory, or a traveler in an airplane, the conventional 12-hour timepiece is unable to act as a true time teller. It is impossible to determine the day time or night time according to such common timepiece.

A specified 24-hour timepiece can partially solve the above problem, which comprises a dial having numerals from 1 to 24 inscribed on the periphery thereof. The movement of the 24-hour timepiece is designed to drive the hour indicating hand rotating just one revolution for 24 hours. People in an indoor surrounding can roughly determine the indicated time of 6 to 18 o'clock as day time and 19 to 5 o'clock as night time. This kind of 24-hour timepiece is particularly useful in military time indicating purpose because it can tell the exact time within 24 hours. Therefore, soldiers have to receive special training to accustom to the sense of time representing by the numerals of 13 to 24 o'clock.

In fact, since the first timepiece invented, it was a 12-hour timepiece. People were used to read the time through numerals 1 to 12. The sense of time is a picture in mind that is respective to accustom human activities at certain designated time. For example, one should wake up at 7:00 am (in early morning), the outdoor weather should be hotter at about 3:00 pm (in the afternoon), one will feel hungry for dinner at 8:00 pm (in the evening), and one will feel tired and sleepy at 10:00 pm (at night). In the other word, people can have immediately response respective to 1 o'clock to 12 o'clock. However, it really bothers people when one read the time indicated by a numeral larger than 12, such as 15, 17, 19 or 22 o'clock, because, generally, people can not picture the sense of time respective to a numeral larger than 12 immediately. It is so troublesome for one to compute the read numerals, 13 to 24, to the accustomed time numerals, 1 to 12, by deducting the numeral larger than 12 by 12. It is the reason that why the 24-hour timepiece is not popular up to now. Nowadays, almost all the timepieces on sale in market are still the 12-hour timepieces. Besides, the conventional 24-hour timepiece still cannot indicate the conditions of time, such as the morning period, afternoon period, evening period, and night period in one day. It is highly desirable in today's market and daily life to have a timepiece that is able to observe the exact time with illustrating the day or night time period as morning, afternoon, evening or night at one time.

Moreover, some timepieces also design for simultaneously indicating the times of at least two time zones, such as the structure disclosed in U.S. Pat. No. 5,323,363, so as to provide convenience for travelers who always travel between different cities. However, the conventional timepiece with simultaneous time display for various time zones comprises very complicated construction which increases the difficulties of manufacture and the manufacturing cost.

For alarm timepiece in prior art, it comprises an alarm generating device which can only preset one predetermined time within 12 hours. If one presets an alarm dock to provide an alarm signal at a predetermined time, for example 8 o'clock, the alarm generating device will alarm both at 8:00 a.m. and 8:00 p.m., twice a day in which one of the alarm signals is undesirable that may cause various inconveniences to the users.

In many circumstances, more than one alarm signals for reminding the user of predetermined time are required in one day. It is so troublesome that people have to set the alarm as many times as the number of alarm signals needed.

SUMMARY OF THE PRESENT INVENTION

Therefore, a main object of the present invention is to provide a time equipment which enables the user to observe at one time, an exact time, including the information of hours, minutes, and/or seconds, day time or night time, and a.m. or p.m. in form of indicating numerals from 1 to 12, as well as the information of the time period in form of morning, afternoon, evening, and night.

Another object of this invention is to provide a time equipment equipped with a time zone means for simultaneously indicating the time for at least two time zones, which is simple in construction and is easy to manufacture.

Another object of this invention is to provide a time equipment equipped with an alarm mechanism for enabling more than one alarm time setting in 24 hours. The improved alarm mechanism is simple in construction and is easy to manufacture.

Further objects and advantages of the present invention will become readily apparent with reference to the ensuing descriptions and drawings.

Accordingly, time equipment according to the present invention, constructed in form of a watch, a clock, or an alarm clock, comprises a case, a dial, and an hour and a minute indicating hands mounted for rotating above the dial. A movement is installed in the case for driving the hour indicating hand to rotate one revolution in 24 hours. A time setting device is installed in the case for setting the time equipment on time. The dial has an hour portion, a minute portion and a period portion, in which the hour portion inscribes two sequences of numerals ordered by increasing value from 1 to 12. The minute portion is positioned adjacent to the hour portion and inscribes a sequence of numerals ordered by increasing value from 1 to 60. The period portion is positioned in at the central area and encircled by the hour portion, which has a central cross inscription having a vertical line extending from top to bottom and a horizontal line extending from right to left so as to divide said period portion into four sections. An alarm generating mechanism can provide more than one alarm signal at predetermined time. An alarm time setting assembly is installed in the case for setting the predetermined alarm time. A switch device is installed in the case for stopping the alarm signal.

DETAILED DESCRIPTION OF THE PREFERRED EMBODIMENT OF THE PRESENT INVENTION

Figure 1:
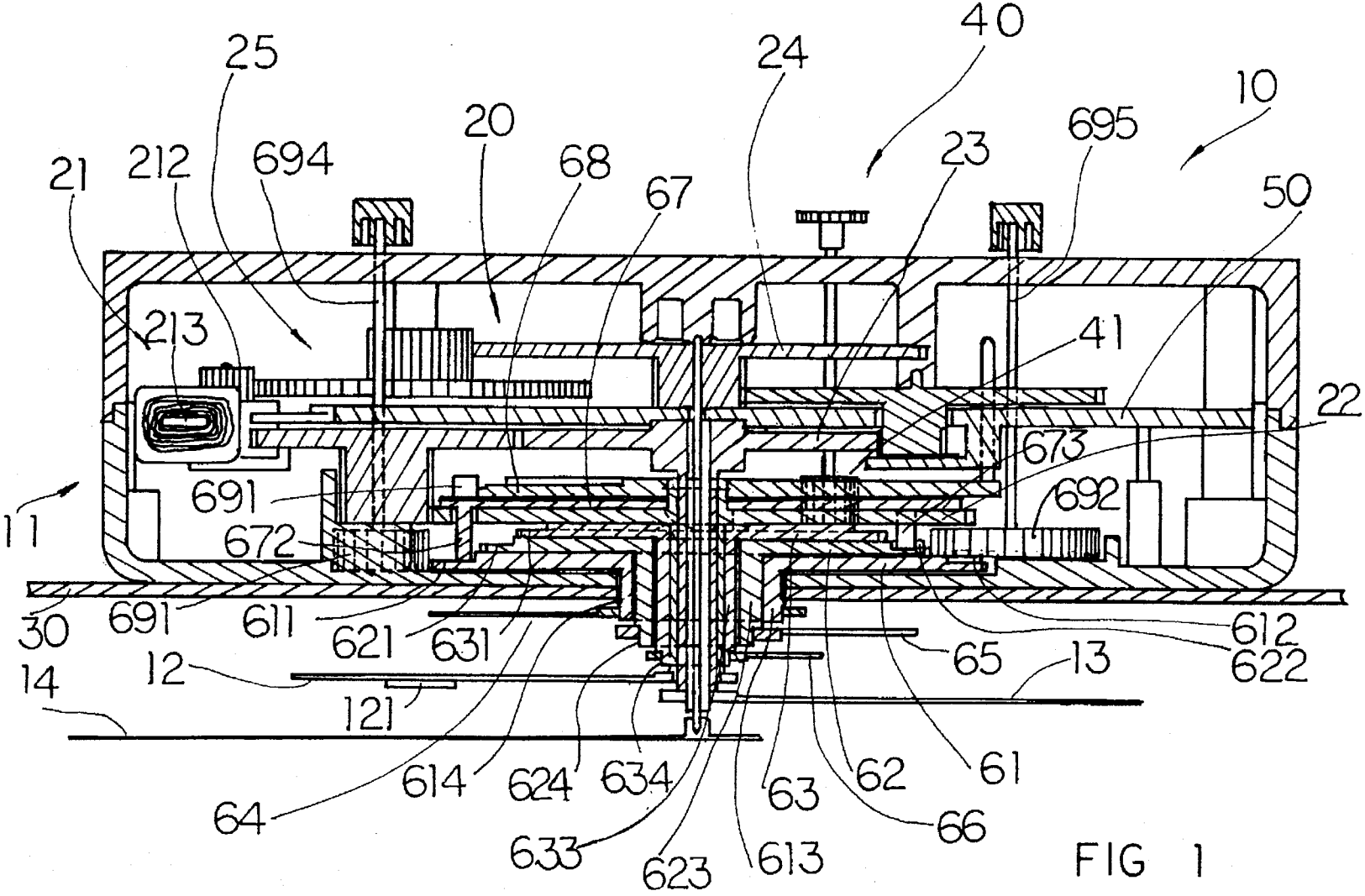
FIG. 1 is a sectional view of a first preferred embodiment of a time equipment according to the present invention.

A time equipment according to the present invention may be constructed in form of a watch, a clock, or an alarm clock. Please referring to FIG. 1, a sectional view of a first preferred embodiment of a time equipment according to the present invention is illustrated. It is constructed in form of an alarm clock 10 which comprises a case 11, an hour indicating hand 12, a minute indicating hand 13, a second indicating hand 14, a movement 20, a dial 30, a time setting device 40, an alarm generating mechanism 50, an alarm time setting assembly 60, and a switch device 70.

Figure 2:
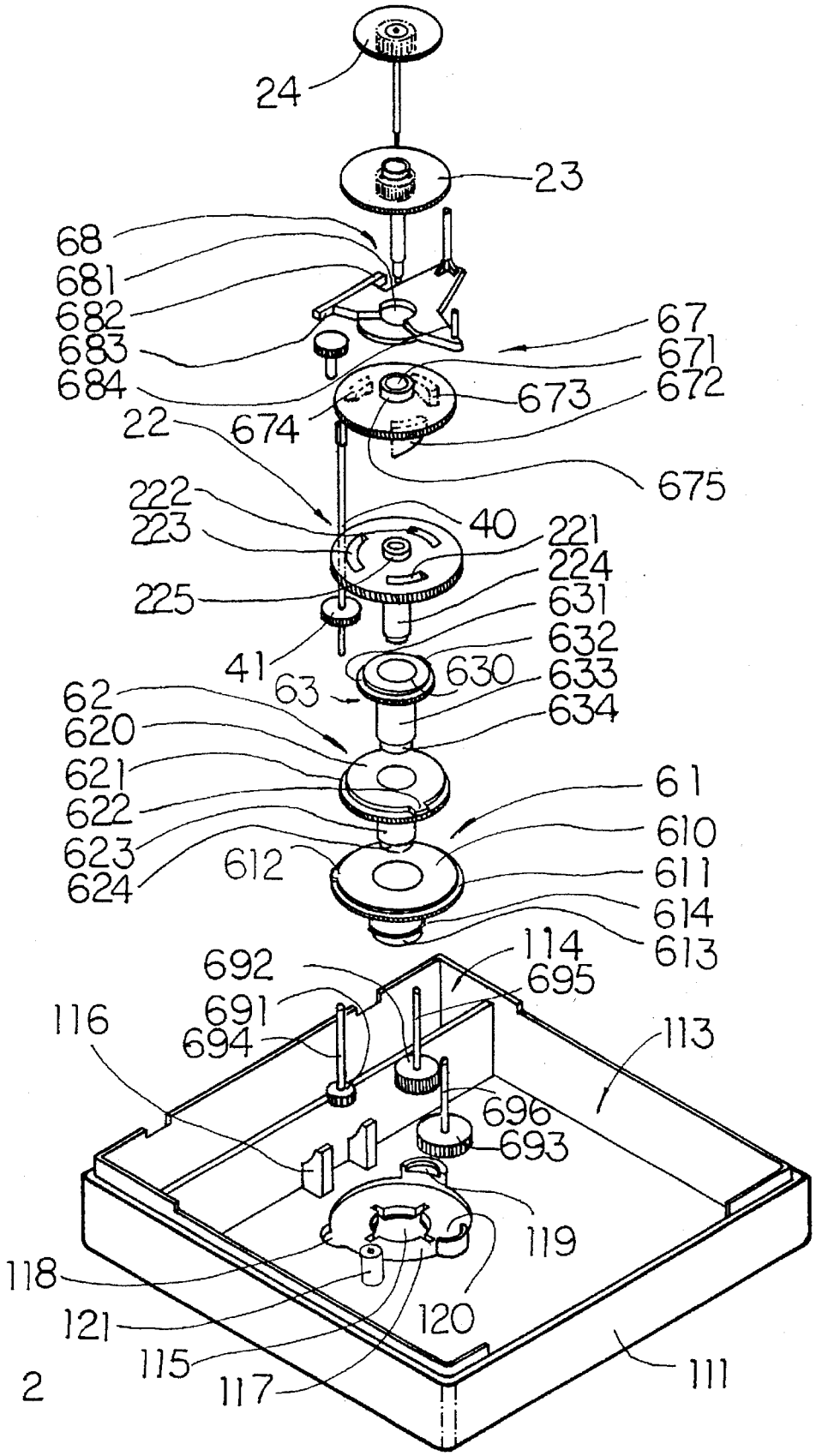
FIG. 2 is a partial exploded perspective view of the above first preferred embodiment of the time equipment according to the present invention, showing the elements of the movement, the time setting device, the alarm time setting assembly, and the first casing.

The case 11 has a first casing 111 and a second casing 112 for receiving the movement 20, the time setting device 40, the alarm generating mechanism 50, the alarm time setting assembly, 60 and the alarm switch device 70 therein in the usual manner. The first casing 111, as shown in FIG. 2, is divided to form a battery receiving socket 114 and a main socket 113 for mounting the movement 20 and the time setting device 40 therein. The main socket 113 has a bottom opening 115, a bracket 116 protruded at one side, a circular wheel recess 117 formed coaxially with the bottom opening 115, and three setting recesses 118, 119, 120 spaced apart from one other, formed along the periphery of the wheel recess 117.

Figure 4:
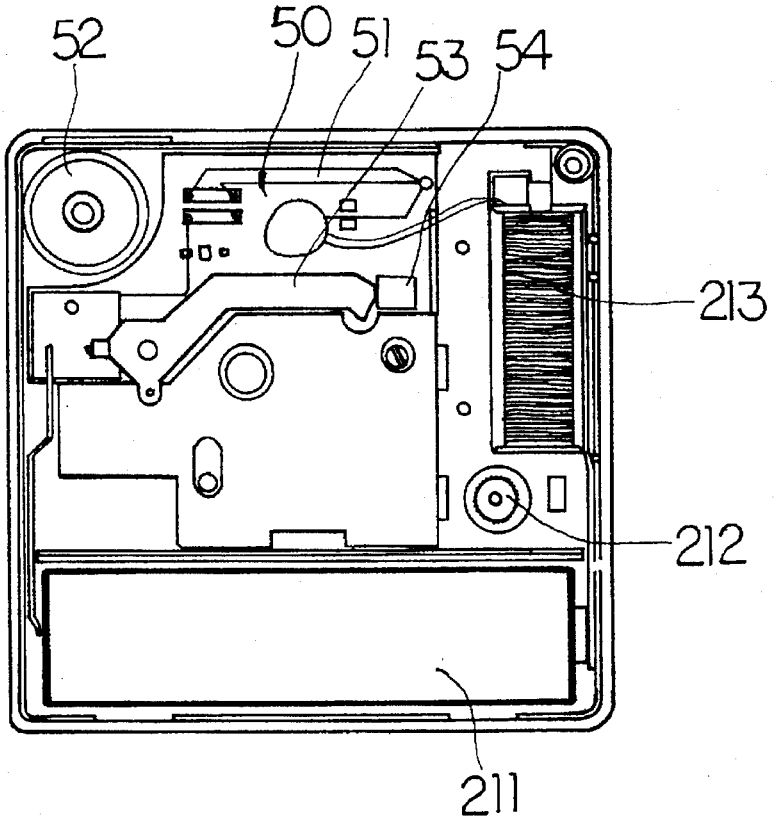
FIG. 4 is a plan view of the above first preferred embodiment of the time equipment according to the present invention in which the second casing is removed.

The hour indicating hand 12, the minute indicating hand 13, and the second indicating hand 14 are driven by the movement 20 installed in the main socket 113 of the case 11, and mounted for rotating above the dial 30. The dial 30 is mounted on the case 11, in the usual manner, for indicating the time in form of hours, minutes and seconds. The movement 20 comprises a power generating device 21, an hour indicating wheel 22, a minute indicating wheel 23, a second indicating wheel 24, and a driving device 25, in a manner known per se. As shown in FIG. 1, 2 and 4, the power generating device 21, in the usual manner, has a power source 211, such as a battery, a main driving wheel 212, and a rotation generating means 213 which enables the main driving wheel 222 to rotate in a predetermined speed. The driving device 25 comprises a plurality of driving wheels for connecting the main driving wheel 212 with the hour, minute and second indicating wheels 22, 23, 24, of which are driven to rotate in a predetermined speed respectively, in a known manner per se. Therefore, the hour indicating wheel 22 as well as the hour indicating hand 12 are driven to rotate one revolution in 24 hours, the minute indicating wheel 23 and the minute indicating hand 13 are both driven to rotate one revolution in 60 minutes, and the second indicating wheel 24 and the second indicating hand 14 are driven to rotate one revolution in one minute.

The alarm generating mechanism 50 provides an alarm signal at a predetermined time, in the usual manner, and comprises an alarm generating circuit 51, an alarm signal generator 52, and a conductive plate 53 electrically connected, as shown in FIG. 4.

The time setting device 40, as shown in FIGS. 1 and 2, in the usual manner, comprises a time setting wheel 41 which is arranged for rotating above a protrusion 121 formed in a predetermined position on the first casing 111 of the case 11 so as to engage with the hour indicating wheel 22. A time setting rod 42 is coaxially and perpendicularly extended from the center of the time setting wheel 41 to penetrate the second casing 112, in order to enable the user to rotate the time setting wheels 41 by rotating the time setting rod 42 to manually drive the hour, minute and second indicating wheel 22, 23, 24 to rotate, for setting the hour, minute and second indicating hands 12, 13, 14 at predetermined time.

Figure 3:
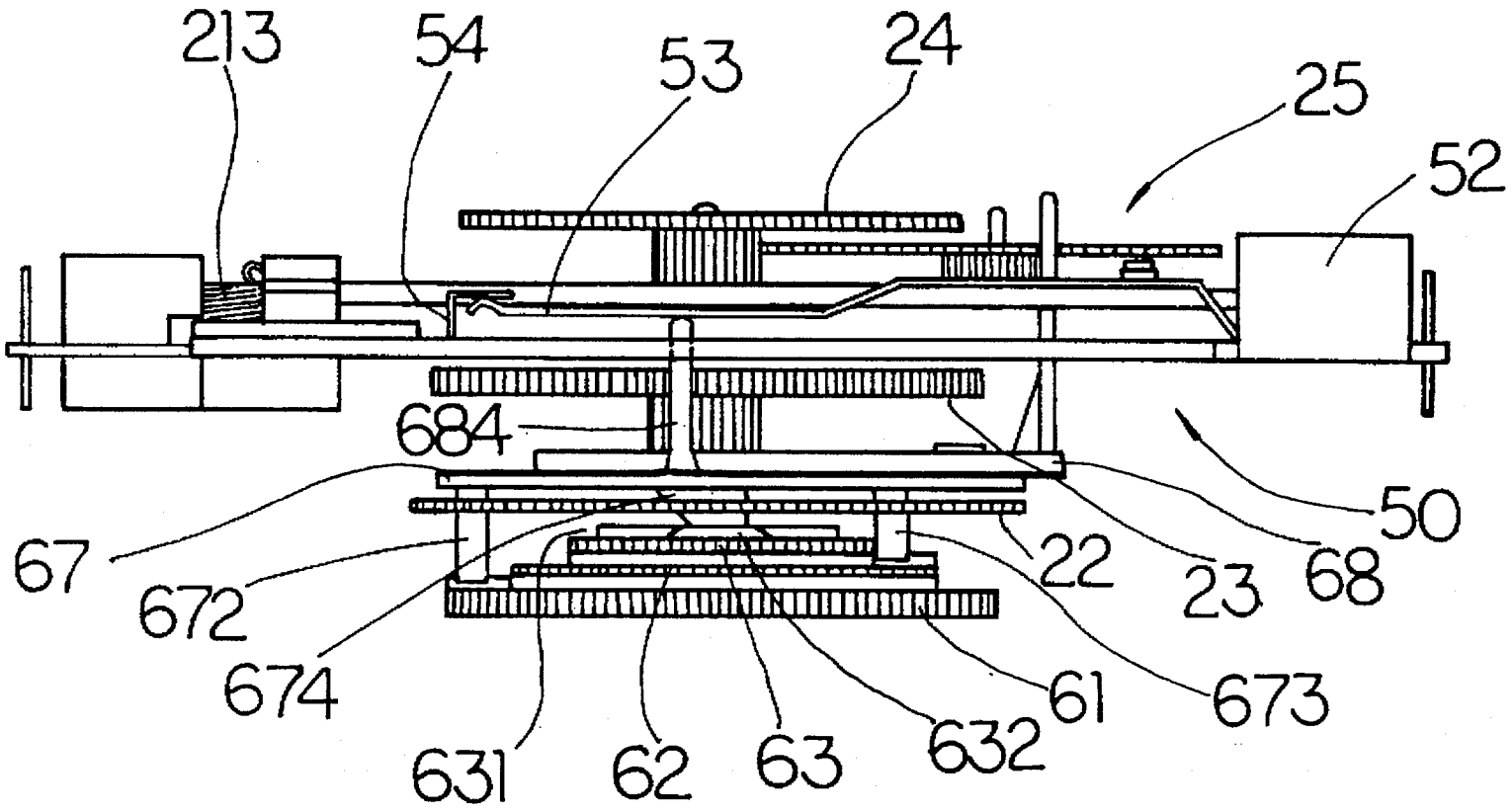
FIG. 3 is a partial sectional view of the above first preferred embodiment of the time equipment according to the present invention, showing the elements of the alarm generating mechanism and the alarm time setting assembly.

The alarm time setting assembly 60, as shown in FIGS. 1, 2 and 3, comprises at least two alarm setting wheels. The are totally three alarm setting wheels 61, 62, 63 according to the present embodiment. Each of the alarm setting wheels 61, 62, 63 has a shoulder rim recess 611,621, 631 with a predetermined width formed along the periphery thereof and a top smooth flat wheel surface 610, 620, 630 respectively. Each of the shoulder rim recess 611,621,631 of the three alarm setting wheels 61, 62, 63 has a step protrusion 612, 622, 632, with two inclined sides protruded thereon respectively. The three step protrusions 612, 622, 632 each has a height at least equal to the depth of the shoulder rim recesses 611,621, 631 respectively.

The first alarm setting wheel 61 has a diameter, slightly smaller than that of the wheel recess 117 on the first casing 111, and a first central hollow shaft 613 extended from a bottom side thereof which has an angular protrusion 614 extended circumstantially and outwardly therefrom. Therefore the first alarm setting wheel 61 is sat on the wheel recess 117 by inserting the first hollow shaft 613 to squeezed through into the bottom opening 115 of the first casing 111, wherein the annular protrusion 614 is lip-fit therein thus preventing the first hollow shaft 613 from disengaging with said first casing 111. A first alarm indicating hand 64 is sheathed to a free end of the first hollow shaft 613.

The second alarm setting wheel 62 has a diameter slightly smaller than that of the top smooth flat surface 610 of the first alarm setting wheel 61 and a second central hollow shaft 623 extended from a bottom side thereof. The second hollow shaft 623 has a length longer than that of the first central hollow shaft 613. A free end of the second hollow shaft 623 has an edge recess 624. The second alarm setting wheel 62 is positioned on the top flat surface 610 of the first alarm setting wheel 61 by rotatably inserting the second hollow shaft 623 through the first hollow shaft 613 of the first alarm setting wheel 61. A second alarm indicating hand 65 is firmly affixed to the edge recess 624 of the free end of the second hollow shaft 623.

The third alarm setting wheel 63 has a diameter slightly smaller than that of the top smooth flat surface 620 of the second alarm setting wheel 62 and a third central hollow shaft 633 extended from a bottom side thereof. The third hollow shaft 633 has a length longer than that of the second central hollow shaft 623. A free end of the third hollow shaft 633 has an edge recess 634. The third alarm setting wheel 63 is positioned on the top fiat surface 620 of the second alarm setting wheel 62 by rotatably inserting the third hollow shaft 633 through the second hollow shaft 623 of the second alarm setting wheel 62. A third alarm indicating hand 66 is firmly affixed to the edge recess 634 of the free end of the third hollow shaft 633.

The alarm time setting assembly 60 further comprises a motion plate 67, a pressing plate 68, and three setting gears 691,692, 693 of different diameters. The first setting gear 691 having the smallest diameter is positioned on the first setting recess 118 on the first casing 111 for engaging with the first alarm setting wheel 61. The second setting gear 692 having a larger diameter is positioned on the second setting recess 119 for engaging with the second alarm setting wheel 62. The third setting gear 693 having a largest diameter is positioned on the third setting recess 120 for engaging with the third alarm setting wheel 63. The three setting gears 691,692, 693 each has a central driving rod 694, 695, 696 extended therefrom to penetrate the case 11 respectively, so that the user can rotate the three driving rods 694, 695, 696 for driving the three setting gears 691,692, 693 to rotate respectively so as to drive the three alarm setting wheel 61, 62, 63 and the three alarm setting indicating hands 64, 65, 66 to rotate respectively and preset their predetermined alarm times respectively.

The hour indicating wheel 22 has three grooves 221,222, 223 formed therethrough and an hour hollow shaft 224, including a first end 225 and a second end 226 centrally passing through the hour indicating wheel 22. The second end 226 penetrates through the three alarm setting wheels 61, 62, 63 for affixing the hour indicating hand 12. Each of the three grooves 221,222, 223 has a predetermined arc length and a different radius, that is the radius between the first, second and third grooves 221,222, 223. The radius of the hour indicating wheel 22 is substantially larger than the radius of the first alarm setting wheels 61. The motion plate 67 has a through hole 671 which periphery forms a top rim 675, three arched projections 672, 673,674, correspondingly and respectively aligned with the grooves 221,222, 223 of the hour indicating wheel 22, and extending downward from a the bottom side of the motion plate 67. Each of the three arched projections 672, 673, 674 has a different height and a slope side. The motion plate 67 is coaxially positioned on the hour indicating wheel 22 with the three arched projections 671,672, 673 inserting through the three grooves 221,222, 223 of the hour indicating wheel 22 respectively, in which the first arched projection 671 falls on the first shoulder rim recess 611, the second arched projection 672 falls on the second shoulder rim recess 621, and the third arched projection 673 falls on the third shoulder rim recess 631, as shown in FIG. 1. The diameter of the motion plate 67 is larger than that of the first alarm setting wheel 61.

The pressing plate 68, disposed on the motion plate 67, has a central opening 681 and two pivot arms 682, 683 pivoted to the bracket 116 of the first casing 111 for pressing the motion plate 67. The top rim 675 is inserted into the central opening 681 for holding the pressing plate 68 in position. The pressing plate 68 further has a projecting rod 684 extended upwardly and perpendicularly therefrom to a position abutting upon the conductive plate 53.

Normally, referring to FIGS. 1 to 4, the pressing plate 68 is held parallelly with respect to the bottom of the first casing 111 in the manner that the projecting rod 684 hasn't contacted with the conductive plate 53. When the hour indicating wheel 22 rotates, the motion plate 67 is also rotated simultaneously. It is so arranged that in one circulation, the three arched projections 671,672, 673 will be aligned only once with the corresponding step protrusions 612, 622, 632 of the three alarm setting wheels 61, 62, 63 respectively. During rotating procedure, if any one of the three arched projections 671, 672, 673 is aligned with the corresponding step protrusion 612, 622 or 632, the respective projection 671,672, or 673 may climb up the corresponding step protrusion 612, 622 or 632 that will cause the motion plate 67 to incline upwardly. The inclined motion plate 67 will press the pressing plate 68 to incline concurrently. Thus, the projecting rod 684 of the pressing plate 68 will move up to push the conductive plate 53 of the alarm generating mechanism 50 to in touch with a terminal contact 54 of the alarm generating circuit 51, for electrically connecting the circuit 51 to generate out an alarm, as shown in FIG. 3. Since each of the step protrusions 612, 622, 632 has a predetermined width, the respective arched projections 672, 673,674 of the motion plate 67 may climb back from the corresponding step protrusions 612, 622, 632 and the alarm will stop automatically.

Accordingly, one can preset totally three alarm times at one time, for example, presetting the first indicating hand 64 at 8:30 a.m. by rotating the first alarm setting wheel 61, presetting the second indicating hand 65 at 12:00 p.m. by rotating the second alarm setting wheel 62, and presetting the third indicating hand 66 at 5:00 p.m. by rotating the third alarm setting wheel 63. When the hour indicating wheel 22 rotates, the motion plate 67 is also rotated concurrently. When the first arched projection 672 of the motion plate 67 climbs up the first step protrusion 612 of the first alarm setting wheel 61, an alarm will be generated at 8:30 a.m. Afterward, when the hour indicating wheel 22 and the motion plate 67 continue to rotate concurrently until the second arched projection 673 climbing up the second step protrusion 622 of the second alarm setting wheel 62, another alarm will be generated at 12:00 p.m. Moreover, the hour indicating wheel 22 and the motion plate will continue to rotate simultaneously until the third projection 674 climbing up the third step protrusion 632 of the third alarm setting wheel 63, so that another alarm will be generated at 5:00 p.m.

Therefore, the user can preset three alarm times or more when more than three alarm indicating wheels and hands are incorporated, according to the user's need. This function is very practical and useful for the user, such as a person who has more than one regular appointments, and the workers in a factory for reminding the time to start to work, prepare for lunch and stop the work.

Figure 5:
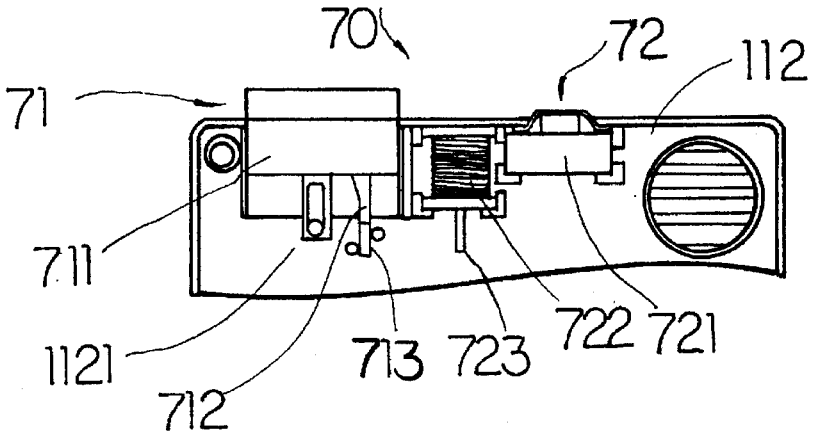
FIG. 5 is a partial plan view of the above first preferred embodiment of the time equipment according to the present invention, showing the switch device.

The switch device 70, as shown in FIGS. 4 and 5, comprises a switch button device 71 and a snooze device 72. The operation of the switch button device 71 can stop the alarm permanently and the operation of the snooze device can stop the alarm temporarily for a predetermined period of time that the alarm generating mechanism 50 is able to generate out alarm again.

The switch button device 71 comprises a button 711 mounted on a rail means 1121 of the second casing 112 that the button 711 can be guided by the rail means 1121 to move in linear direction up and down. The bottom side of the button 711 provides a stopping lever 712 extending downward to a position adjacent to the conductive plate 53. The inner side of the lever 712 forms a sloping surface 713. When the button is in an upper position, as shown in FIG. 5, the lever 712 is apart from the conductive plate 53 of the alarm generating mechanism 50. If the user press the button 711 downwardly to a lower position, the stopping lever 712 will move downwardly to press the conductive plate 53 apart from the terminal contact 54 and thus disconnecting the circuit 51 permanently.

The snooze device 72 comprises a contact switch 721, a delay circuit or a timer circuit incorporating with the alarm generating circuit 51, and an electromagnetic means 722 which has a lever 723 extending downward and is electrically connected with the alarm generating circuit 51. When an alarm is generated, the user can press the contact switch 721 once to actuate the electromagnetic means 722 to push a lever 723 thereof downward to press the conductive plate 53 away from the terminal contact 54 for a predetermined interval of time. The predetermined time interval should be longer than the time period of the alarm generated. After the predetermined time interval, the electromagnetic means 722 will be actuated to pull back the lever 723 by means of the delay circuit to leave the conductive plate 53 automatically. Thus, and thus the alarm dock 10 is ready to generate out alarm again at the next preset alarm time. The snooze device 72 can be controlled by a conventional remote assembly (not shown in the Figures). It is obvious to those skilled in the art that various existed mechanical or electrical snooze mechanism can be made instead of the switch device 70 disclosed above. Moreover, the above described first embodiment can be easily modified to a alarm watch configuration. Thus those skilled in the art will readily recognize that modifications can be made on the above description without departing from the spirit of the invention.

Therefore, one can preset at least two alarm times in one day according to their need. It is very useful and convenience for reminding a person who has various regular appointments everyday and utilizing in a company or school by presetting the time of starting to work and stopping to work as the various alarm times. On the other hand, the user can also preset the three alarm indicating hands 64, 65 and 66 aligned in a same alarm time position in order to achieve just one alarm in one day.

Figure 6:
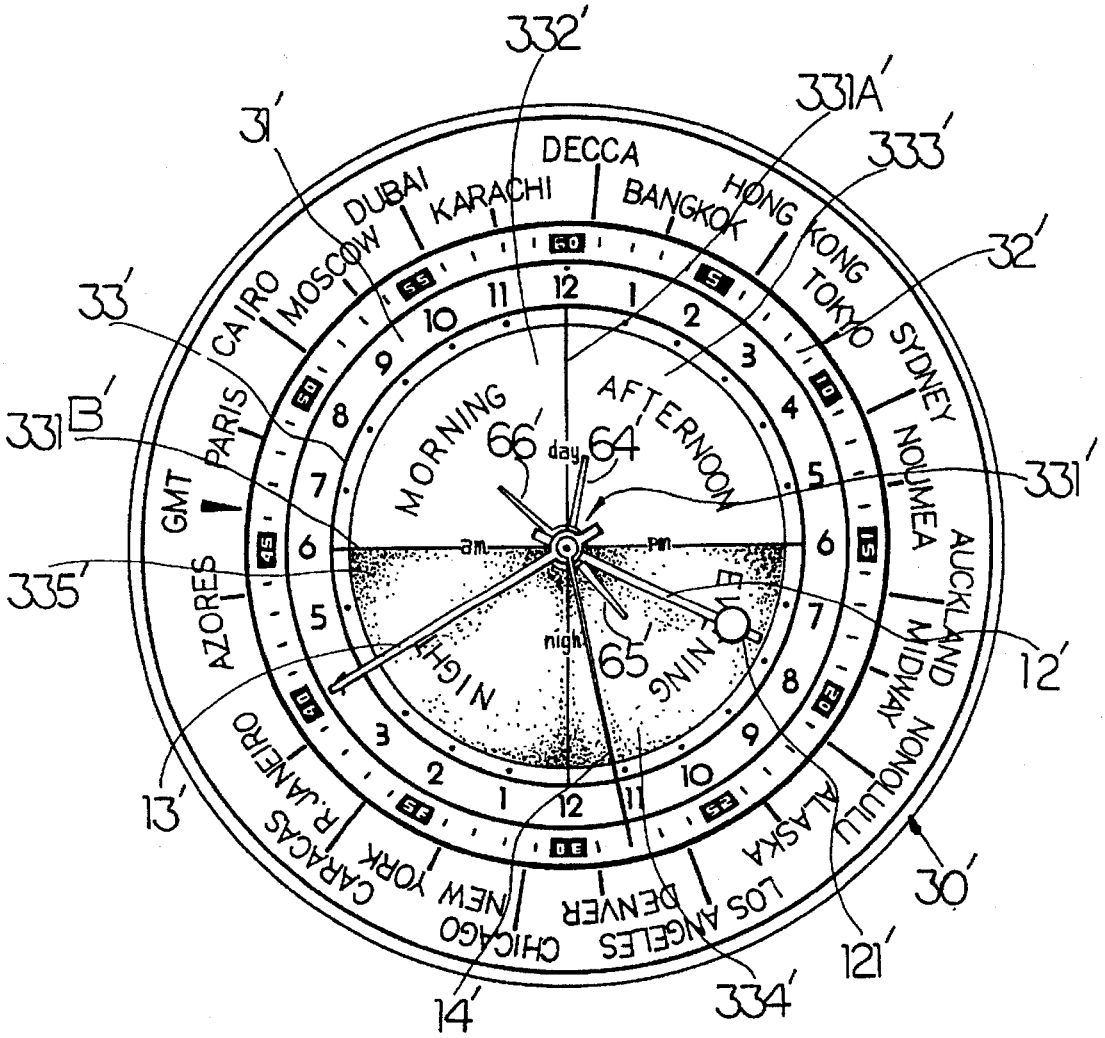
FIG. 6 is a front view of the above first preferred embodiment of the time equipment according to the present invention, showing the 2–12 dial and the time zone ting.

The best performance and features of the above described alarm clock 10, which may preset at least two alarm time, can be achieved by equipping with a 2–12 dial 30 according to the present invention. The 2–12 dial 30, as shown in FIG. 6, has an hour portion 31, a minute portion 32 and a period portion 33. The hour portion 31 inscribes two sequences of numerals ordered by increasing value from 1–12. The two sequences of numerals are arranged circularly and evenly spaced apart angularly, in which the first numeral 12 is inscribed in a top position, the second numeral 12 is inscribed in a bottom position, and the two numerals 6 are inscribed in a right and a left position. The minute portion 32 is positioned adjacent to the hour portion 31 and with inscribed a sequence of numerals ordered by increasing value from 1 to 60. The sequence of numerals are arranged circularly and evenly spaced apart angularly. In which the numeral 60 is inscribed in a top position adjacent to the upper first numeral 12 of the hour portion 31 and the numeral 30 is inscribed in a second lower position adjacent to the second numeral 12 of the hour portion 31. Some of the above numerals representing the hours or minutes can be inscribed as a fullstop mark or a line mark. According to present embodiment, the minute portion 32 is located at an outer position while the hour portion 31 is located at an inner position, so that the longer minute and second indicating hands 13, 14 are extended to the minute portion 32 and the shorter hour indicating hand 12 is extended to the hour portion 31.

The period portion 33 of the dial 30 is positioned at the central area and encircled by the hour portion 31. The period portion 33 has a central cross inscription 331 having a vertical line 33 la extended from a top to a bottom position a horizontal line **331*b* extended from a left to a right position so as to divide the period portion 33 into four sections 332, 333,334, 335. On a the top part of the vertical line 331*a*, a "day" mark is inscribed. On a bottom part of the vertical line 331*a*, a "night" mark is inscribed. Also, on a right part of the horizontal line 331*b*, an a.m. mark is inscribed. On a left part of the horizontal line 331*b*, a p.m. mark is inscribed. Furthermore, on the top left and right sections 332, 333 of the period portion 33, a "MORNING" mark and an "AFTERNOON" mark are inscribed in predetermined positions respectively. Also, on the bottom right and left sections 334, 335 of the period portion 33, an "EVENING" mark and a "NIGHT" mark are inscribed in predetermined positions respectively. Besides, a circle sun mark 121 is affixed on the hour indicating hand 12**.

Accordingly, the user can observe the exact time information including the hour, minute and second indicated by the hour, minute and second indicating hands 12, 13, 14 respectively. Moreover, the user can also easily observe the exact time period information at the same time by determining the location of the hour indicating hand 12 as well as the sun mark 121 thereon. Since the dial 30 utilizes the two sequences of numerals from 1 to 12 instead of the common 24-hour dial which inscribed only one sequence of numerals from 1 to 24, no matter where is the hour indicating hand 12 located, the user can simply read the numeral less than "12" pointed by the hour indicating hand 12 as the time information. If the sun mark 121 is located in the left part, it means that the time read is in the a.m. period. On the other hand, if the sun mark 121 lies on the right part, it means that the time read is in the p.m. period. Therefore, the user can also determine immediately by intuition the information of the day time or night time by observing the location of the sun mark 121, being on the upper part or lower part of the period portion 33. There is no timepiece now existed can provide such detail observation provided by the present invention. The user can easily determine the read time belong to which period of time in a day, such as the rooming, afternoon, evening, and midnight, by observing the sun mark 121 located in which period sections 332, 333,334, 335 of the period portion 33. As shown in FIG. 6, one can easily and immediately read the time indicating on the dial 30 that, as an example shown in FIG. 6, it is "7:40 p.m. and 28 seconds in the evening", of which the user is accustomed to picture the condition and sense of time simply by intuition. To the conventional 24-hour dial, the user can only read an information of "19 o'clock 40 minute and 28 second".

It is worth to mention that the four sections 332, 333, 334, 335 can also be divided by four different colours. Moreover, with the present of the sun mark 121 attached on the hour indicating hand 12, it just likes the actual sun rising from the East to West while the sun mark 121 rotating from leer to right on the upper "day" portion in the period portion 33. Thus, when the sun mark 121 travels from right to left on the lower "night" portion in the period portion 33, it just likes the actual sun sinking below the azimuth. So that it is very easy for the users to catch the sense of time of various time periods according to the present invention.

By utilizing the above 2–12 dial 30, the alarm clock 10 can preset more than one alarm time very easily and without any confusion. Besides, each of the preset alarm times will only generate out one alarm signal respectively within one day. The troublesome of the conventional alarm clock that will automatically provide two alarms at one preset time, both in the day time and the night time, can thus be avoided.

Figure 7:
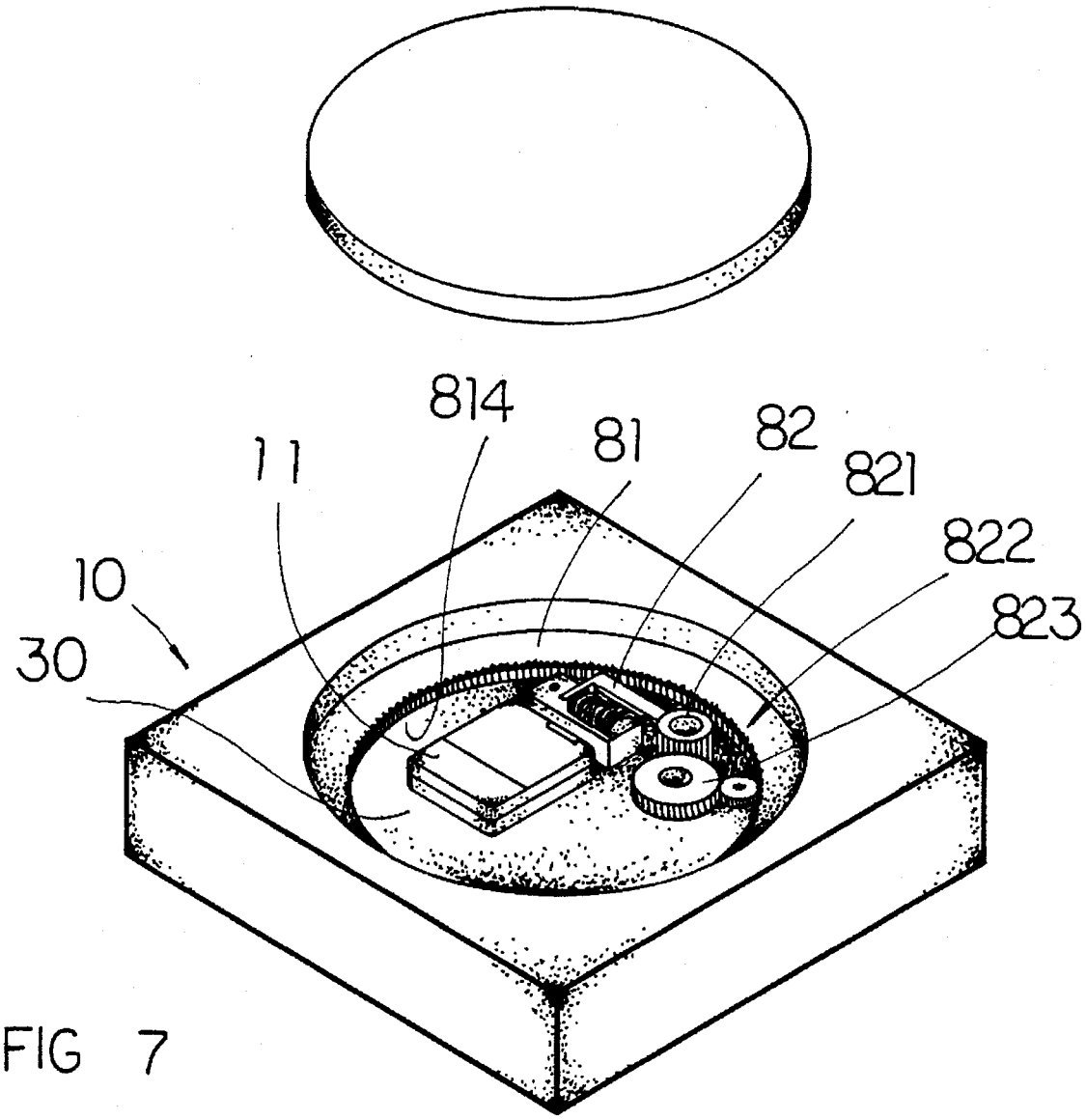
FIG. 7 is a back view of the above first preferred embodiment of the time equipment according to the present invention, showing the time zone means.

Please referring to FIGS. 6 and 7, the alarm dock 10 further comprises a time zone means 80 which includes a time zone ring 81 coaxially mounted for rotating around the periphery of the 2–12 dial 30. A front surface of the time zone ring 81 bears a series of 24 time zone inscriptions 812 which are the name of 23 representing cities and a GMT mark of the predetermined time zones. These inscriptions 812 are arranged in the same order as the time zones and each one is located in one of the 23 parts of the front top surface of the ring 81. Thus, when the user would like to know the time right now in other time zone cities, the user can simply rotate the time zone ring 81 until the time zone inscription representing the local city, that is the city the user resided, aligned with the hour indicating hand 12. Then the user can simply read the indicated time which is pointed by an indicating mark 813 extended inwardly from the time zone inscription 812 representing the other desired city.

The time zone means 80 according to the present embodiment further comprises a time zone mechanism 82 for rotating the time zone ring automatically in one revolution in 24 hours, as shown in FIG. 7, so that the time zone inscription 812 which represents the city the user resided will rotate simultaneously following the rotation of the hour indicating hand 12.

The inner side of the time zone ring 81 further provides a series of inner gear teeth 814. The time zone mechanism 82 comprises a time zone movement 821 and a driving device 822 driven by the time zone movement 821. The driving device 822 comprises a driving gear 823 engaged with the inner gear teeth 814 of the time zone ting 81 for driving the time zone ring 81 to rotate one revolution in 24 hours.

Figure 8:
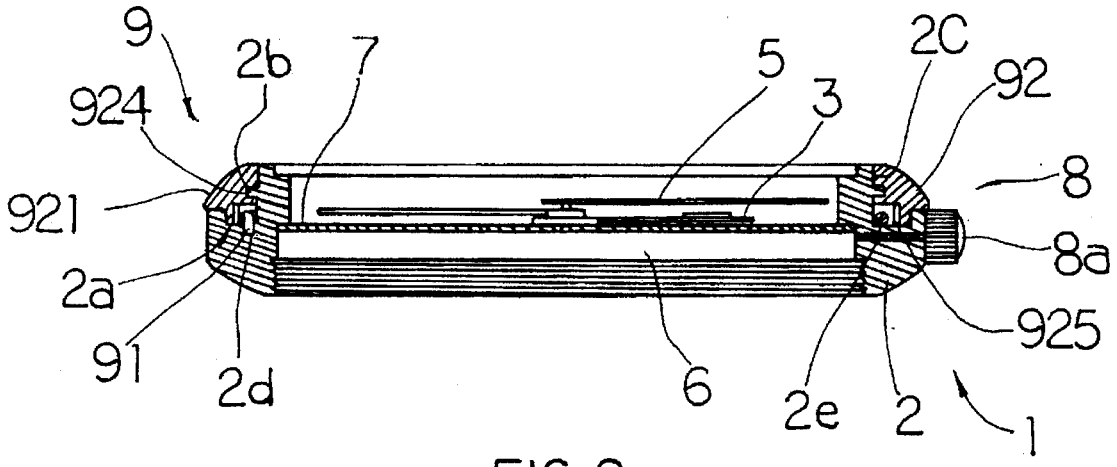
FIG. 8 is a partial sectional view of a second preferred embodiment of a time equipment according to the present invention.
Figure 9:
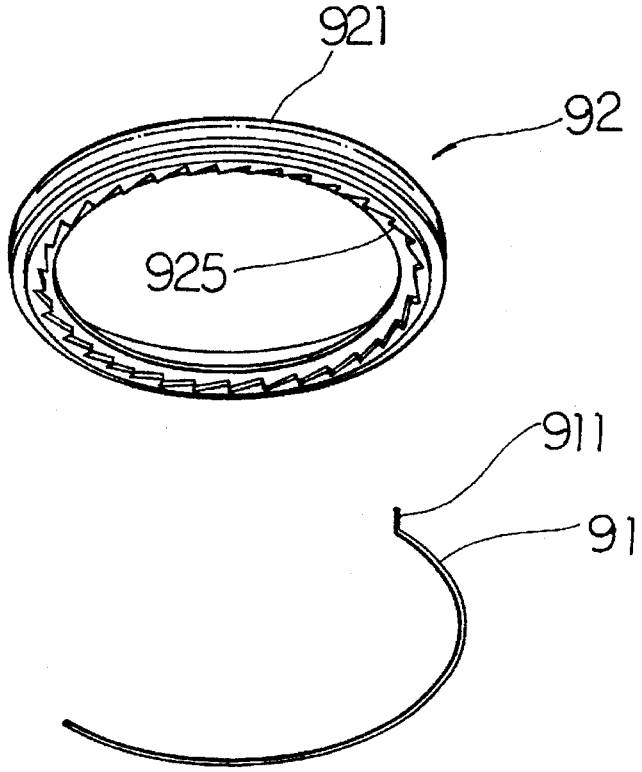
FIG. 9 is a partial exploded perspective view of the time zone ting and the spring of the above second preferred embodiment of the time equipment according to the present invention.
Figure 10:
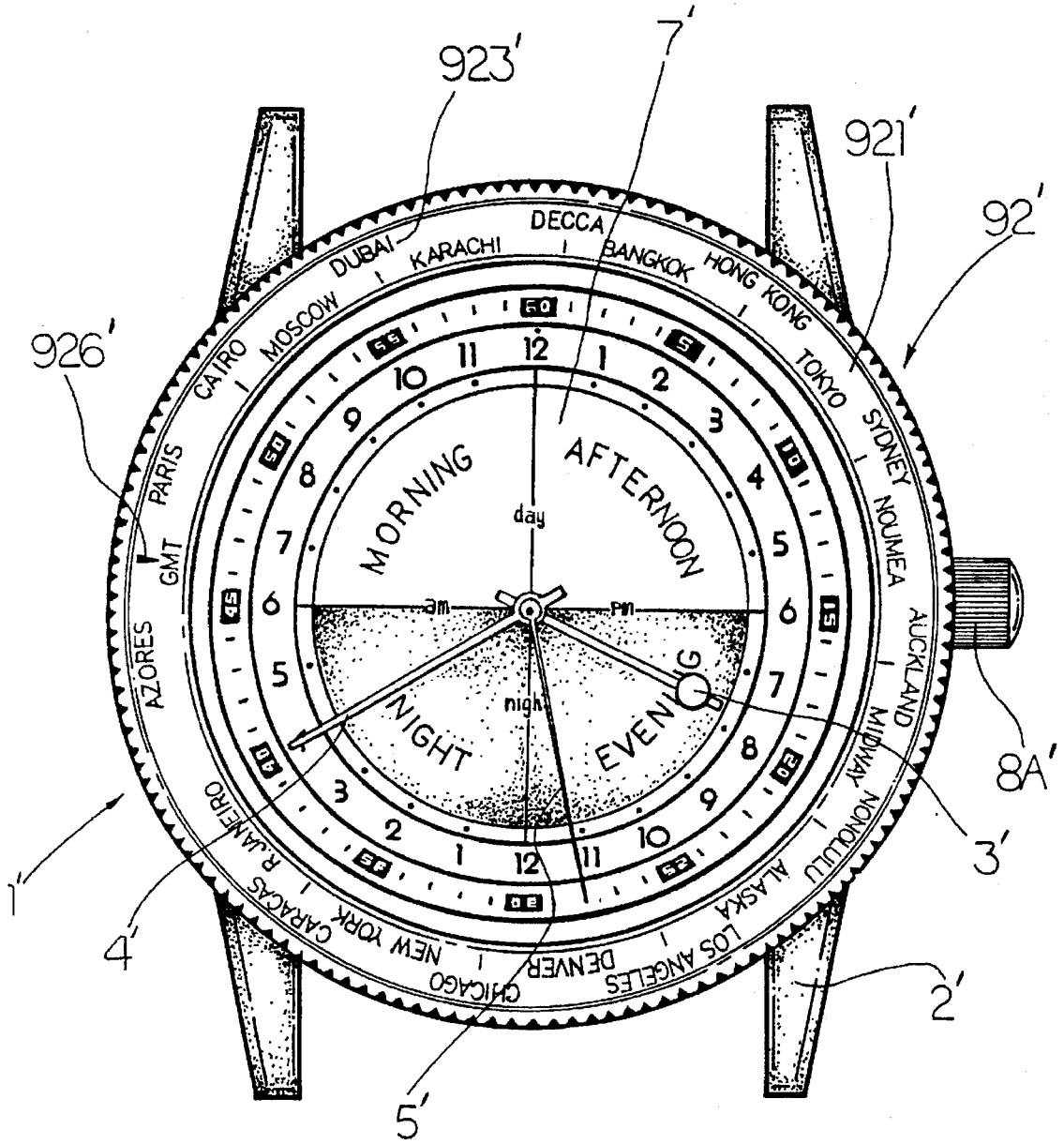
FIG. 10 is a front view of the above second preferred embodiment of the time equipment according to the present invention, showing the 2–12 dial and the time zone ring.

Please referring to FIG. 8 to 10, a second preferred embodiment of the time equipment according to the present invention is illustrated. It is constructed in form of a watch 1 which comprises a watch case 2 for receiving an hour indicating hand 3, a minute indicating hand 4, a second indicating hand 5, a movement 6, a dial 7, a time setting device 8, and a time zone means 9.

The dial 7 is a 2–12 dial as described in the above first embodiment on which the hands 3, 4, 5 are mounted thereabove and driven by the movement 6 in the usual manner, so as to indicate, respectively, hour, minute and second. The movement 6 of the second embodiment, as in the first embodiment, is able to drive the hour indicating hand 3 to rotate one revolution in 24 hours. So that the watch 1 also enables the user to observe at one time an exact time including the information of hours, minutes, and seconds of day time or night time (am or pm) in form of indicating numerals 1 to 12, as well as the time periods in form of morning, afternoon, evening, and night. Thus the watch 1 can achieve the effective as mentioned in the above first embodiment.

The time setting device 8, as the known art manner, is incorporated with the movement 6 and has a button **8*a* positioned at "6:00 pm" making it possible to rotate the hands 3, 4, 5 in a conventional manner, for setting the watch 1 on time and also for rewinding the watch movement 6** in the case of the latter being mechanical.

The time zone means 9 comprises a C-shape spring 91 and a time zone ring 92 rotatably mounted on an outer time zone recess **2*a* formed in the outer rim of the case 2. The time zone recess 2*a* has a circular rim protrusion 2*b* protruded, outwardly and circumferentially, along a vertical outer periphery side 2*c* thereof and a hole 2*d* on a predetermined position on a horizontal periphery surface 2*e* thereof. One end of the spring 91 is perpendicularly bent to form a tail 911 which is inserted into the hole 2d so as to hold the spring 91 an in the time zone recess 2*a*. The time zone ring 92 has a curved outer surface 921 and an inner surface 922. The curved outer surface 921 bears a series of 24 time zone inscriptions 923 which are the name of 23 representing cities and a GMT mark of the predetermined time zones. These inscriptions 923 are arranged in the same order as the time zones and each one is located in one of the 23 parts of the outer surface 921 of the ring 92. The inner surface 922 of the ring 92 forms a circular groove 924 so that the ring 92 can be rotatably mounted firmly in position on the recess 2*a* by means of the clipped-fit locking between the groove 924 and the circular rim protrusion 2*b*. The lower portion of the inner surface further provides a ring of ratchet teeth 925. The other free end of the spring 91 is engaged with the ratchet teeth 925 so as to hold the ring 92 firmly by the spring pressing force and to enable the ring 92 to rotate in anti-clockwise direction only, and that the ratchet teeth 925 acts as a stopping means to prevent the ring 92 to rotate clockwise. Thus, when the user would like to know the time right now in other time zone city, the user can simply rotate the time zone ring 92 anti-clockwise until the time zone inscription representing the local city, that is the city the user resided. Then the user can simply read the indicated time which is pointed by an indicating mark 926 extended inwardly from the time zone inscription 923** representing the other desired city.

Figure 11:
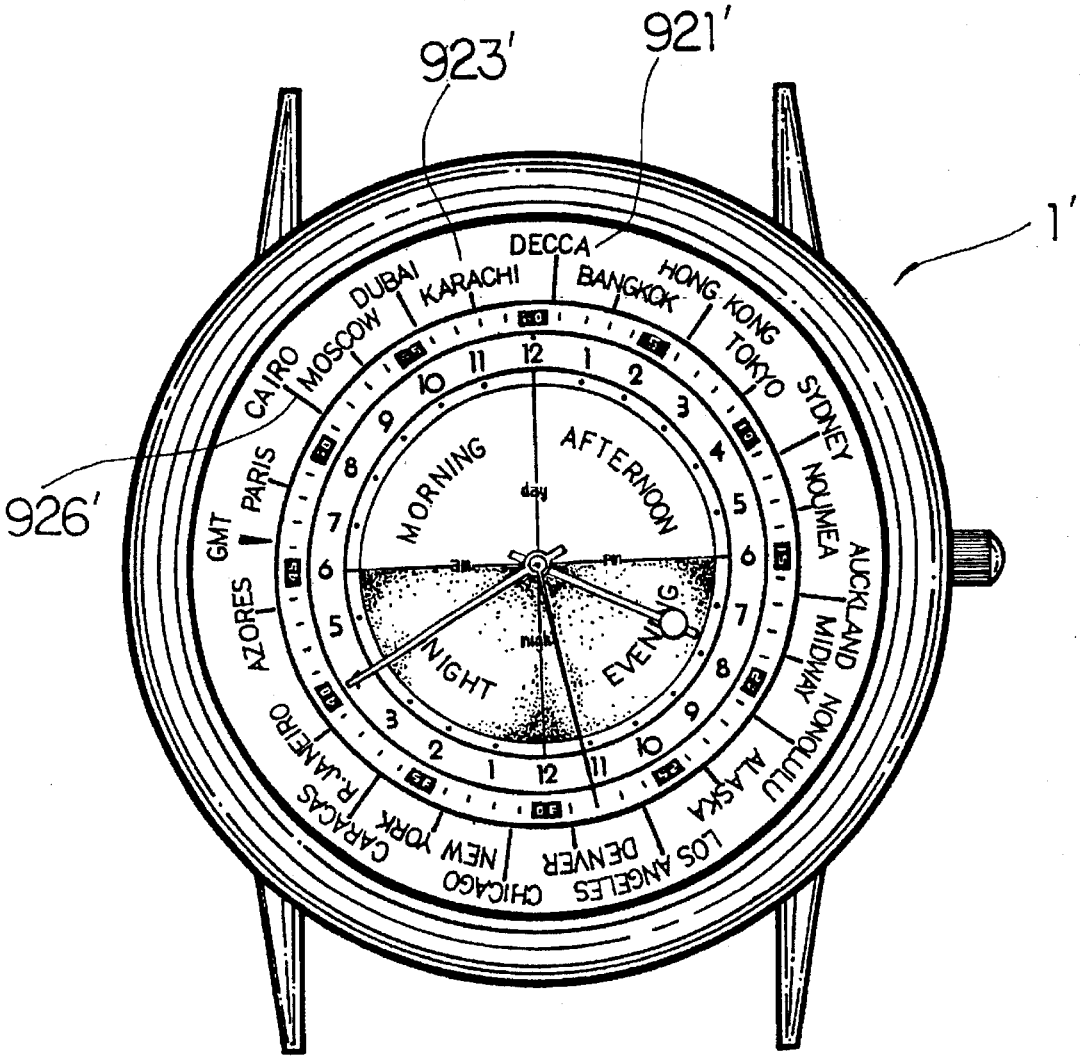
FIG. 11 is a front view of a third preferred embodiment of the time equipment according to the present invention, showing the 2–12 dial and the build-in time zone ring.
Figure 12:
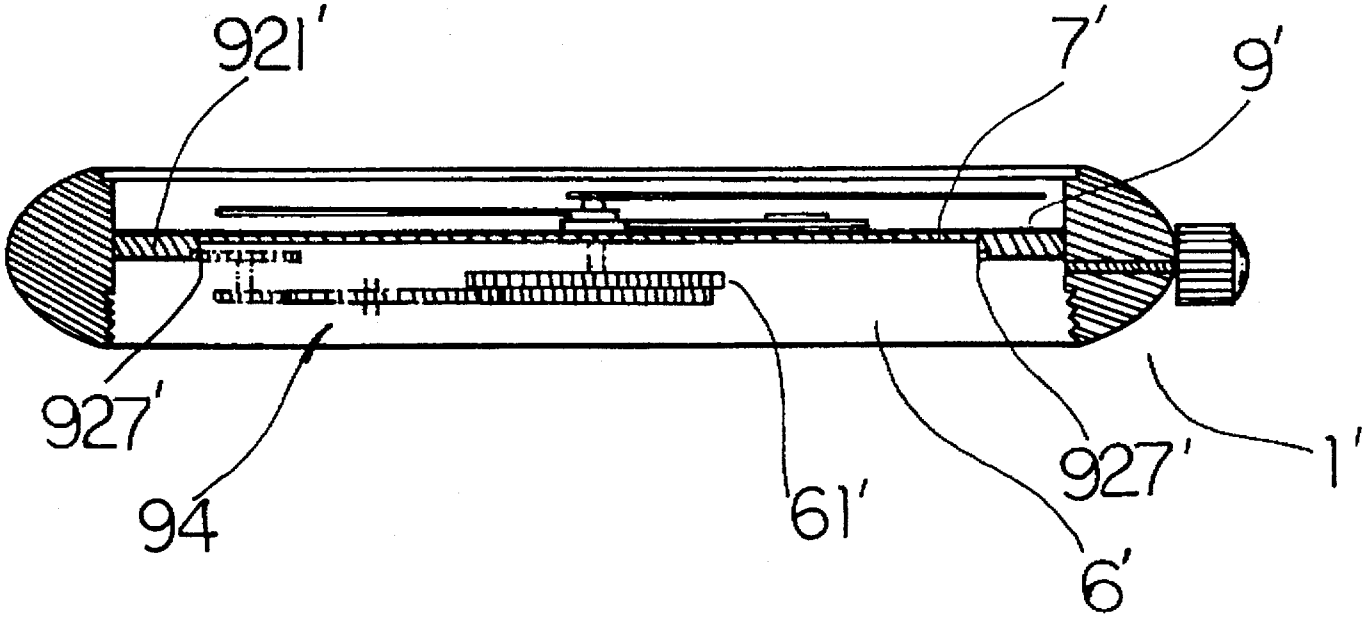
FIG. 12 is a partial sectional view of FIG. 11.

Please referring to FIG. 11 and 12, a third preferred embodiment is illustrate. It is constructed in form of a watch 1' having configuration similar to the above second embodiment, in which the time zone means 9' comprises a build-in time zone ring 921' and a time zone driving mechanism 93' for rotating the time zone ring 921' automatically in one revolution in 24 hours. The time zone ring 921' is coaxially mounted around the periphery of a 2–12 dial 7' and bears a series of time inscriptions 923'. The inner bottom side of the time zone ring 921' provides a series of gear teeth 927'. The time zone driving mechanism 93' comprises a plurality of transmitting wheels 94' for connecting by means of engagement with an hour indicating wheel 61' of the movement 6' and the gear teeth 927' of the ring 921' so as to transmit the ring 921' to rotate one revolution in 24 hours as long as the rotation of the hour indicating wheel 61'. Thus, the time zone inscription 923' which represents the city the user resided will rotate simultaneously following the rotation of the hour indicating wheel 61'. Thus, the user can observe the rime of other cities indicating on the time zone ring 921' any time through the indicating marks 926' inscribed adjacent to the inscriptions 923' respectively.

In accordance with the above disclosure above, the time equipment of the present invention enables the user to observe at one time an exact time indicating hours, minutes, seconds, day or night, am or pm, and various time periods in form of morning, afternoon, evening, and midnight. Moreover, the time equipment is able to equip with a time zone means for simultaneously indicating the time for a plurality of time zones, which is simple in construction and is easy to manufacture. Besides. The time equipment is further able to equip with an alarm mechanism for enabling more than one alarm rime setting in 24 hours. The improved alarm mechanism is simple in construction and is easy to manufacture.

I claim:

1. A time equipment, comprising a case;

a dial installed in said case comprising an hour portion, a minute portion and a period portion, in which said hour portion inscribing two sequences of numeral ordered by increasing value from 1 to 12 that said two sequences of numerals are arranged circularly spaced apart angularly, said first numeral "12" being inscribed in a top position of said hour portion, said second numeral "12" being inscribed in a bottom position of said hour portion, said two numerals "6" being inscribed in a right and a left position of said hour portion respectively, said minute portion being positioned adjacent to said hour portion and inscribing a sequence of numerals ordered by increasing value from 1 to 60 which are arranged circularly spaced apart angularly, wherein said numeral "60" is inscribed in a top position of said minute portion adjacent to said first numeral "12" of said hour portion, said numeral "30" being inscribed in a bottom position of said minute portion adjacent to said second numeral "12" of said hour portion, said period portion being positioned in a central area of said dial and encircled by said hour portion, in which said period portion has a central cross inscription having a vertical line extending from a top position to a bottom position of said period portion and a horizontal line extending from a left position to a right position of said period portion, so as to divide said period portion into a top-left section, a top-right section, a bottom-left section, and a bottom-right section for representing four different conditions of time, including a morning condition of time, an afternoon condition of time, an evening condition of time, and a night condition of time respectively, moreover, a "day" mark being inscribed on a top part of said vertical line, a "night" mark being inscribed on a bottom part of said vertical line, an "a.m." mark being inscribed on a left part of said horizontal line, a "p.m." being inscribed on a right part of said horizontal line, a "MORNING" mark and an "AFTERNOON" mark being inscribed on a predetermined position of said top-left and top-right sections of said period portion respectively, an "EVENING" mark and a "NIGHT" mark being inscribed on a predetermined position of said bottom-right and bottom left sections of said period portion;

an hour, a minute and a second indicating hands mounted for rotating above said dial;

a movement installed in said case to drive said hour indicating hand to rotate one revolution in 24 hours and to drive said minute and said second indicating hands to rotate one revolution in 60 minutes and 60 seconds respectively;

a time setting device installed in said case for setting said hour, minute and second indicating hands on time; and a time zone means including a time zone ring coaxially mounted for rotating around a periphery of said dial, said time zone ring having a front surface bearing 24 time zone inscriptions which are arranged in a same order as 24 time zones, thereby when one of said time zone inscriptions, representing a local city, of said time zone ring is aligned with said hour indicating hand, another 23 times of said other 23 time zone inscriptions representing the other 23 time zone cities are simultaneously read according to said corresponding aligned hour numerals inscribed on said hour portion of said dial, said time zone means further comprising a C-shape spring which one end is bent to form a tail, an outer rim of said case forming an outer time zone recess which has a circular rim protrusion protruded outwardly form a vertical outer periphery side of said time zone recess and a hole on a predetermined position on a horizontal periphery surface of said time zone recess, said tail of said spring being inserted into said hole so as to be held on said time zone recess, an inner surface of said time zone ring forming a circular groove so that said time zone ring is rotatably mounted in position on said time zone recess by means of a clipped-fit locking between said circular groove and said circular rim protrusion, a lower portion of said inner surface of said time zone ring further providing a ring of ratchet teeth, on which another free end of said spring is engaged thereto, so that said time zone ring capable of rotating in an anti-clockwise direction while said ratchet teeth acting as a stopping means to prevent said time zone ring to rotate clockwise.

2. A time equipment, as recited in claim 1, in which said alarm time setting assembly comprises at least two alarm setting wheels coaxially disposing layer upon layer on a bottom side of said case, each of said setting wheels having a shoulder rim recess with a predetermined width formed along a periphery thereof respectively; each said shoulder rim recess having a step protrusion with two inclined sides protruded thereon, each of said step protrusions having a height at least equal to a depth of said corresponding shoulder rim recesses respectively, each of said alarm setting wheels having a different diameter that said lower located alarm setting wheel has a diameter larger than that of said upper located alarm setting wheel;

at least two alarm setting hands which are mounted to said respective alarm setting wheels for rotating above said dial;

said movement comprising an hour indicating wheel coaxially placed above said alarm setting wheels for driving said hour indicating hand to rotate, said hour indicating wheel having at least two grooves formed therethrough and a diameter larger than that of said alarm setting wheels;

said alarm generating mechanism comprising an alarm generating circuit having a terminal contact and a conductive plate electrically disconnected with said terminal contact;

said alarm time setting assembly further comprising a motion plate, a pressing plate, and at least two setting gears of different diameters engaged with said corresponding alarm setting wheels respectively for driving said alarm setting wheels to rotate respectively by rotating said setting gears, so as to drive each said alarm setting wheel and each said alarm setting hand to rotate and preset a predetermined alarm time;

said motion plate, coaxially placed on said hour indicating wheel, having at least two projections, correspondingly and respectively aligned with said grooves of said hour indicating wheel, and extending downward from a bottom side of said motion plate, each of said projections having a different height and a slope side for inserting respectively through said corresponding groove of said hour indicating wheel and falling on said shoulder rim recess of said corresponding alarm setting wheel; and said pressing plate, disposed on said motion plate, having a projecting rod extended upwardly therefrom to a position abutting upon said conductive plate of said alarm generating mechanism; whereby said pressing plate is held in such a manner that said projecting rod hasn't contacted with said conductive plate, and thus when said hour indicating wheel rotates, said motion plate is also rotated concurrently; said alarm time setting assembly being so arranged that in one circulation, said projections of said motion plate being aligned only once with said corresponding step protrusions of said alarm setting wheels respectively, so that during rotating procedure, when one of said projections is aligned with said corresponding step protrusion, said respective projection climbs up said corresponding step protrusion, and thus said motion plate and said pressing plate being pressed to an incline position, so as to move said projection rod to press said conductive plate to in touch with said terminal contact for electrically connecting to generate an alarm signal.

3. A time equipment, as recited in claim 2, in which said switch device comprises a switch button device for stopping said alarm signal permanently, which comprises a button mounted on a rail means provided in said case for guiding said button to move in linear direction, a bottom side of said button having a stopping lever extending downward to a position adjacent to said conductive plate; whereby when said button is in an upper position, said lever is apart from said conductive plate of said alarm generating mechanism, and that when said button is pressed downwardly to a lower position, said stopping lever is move downwardly to press said conductive plate apart from said terminal contact and thus disconnecting the said alarm generating circuit permanently.

4. A time equipment, as recited in claim 3, in which said switch device further comprises a snooze device for stopping said alarm signal temporarily for a predetermined interval of time, after said predetermined time interval, said alarm generating mechanism generating another alarm signal again automatically; said snooze device comprising a contact switch, a delay circuit incorporating with said alarm generating circuit, and an electromagnetic means which has a lever extending downward and is electrically connected with said alarm generating circuit; whereby when said contact switch is press once during the alarm signal for actuating said electromagnetic means, said lever is pushed downward to press said conductive plate away from said terminal contact for a predetermined interval of time which is longer than the time period of said alarm signal generated, and that after said predetermined time interval, said electromagnetic means is actuated to pull back said lever to leave said conductive plate automatically, and thus said alarm generating mechanism is ready for generating another alarm signal again at the next preset alarm time.

5. A time equipment, as recited in claim 2, in which said first alarm setting wheel having the largest diameter is positioned at a bottom layer and has a first central hollow shaft extended from a bottom side thereof for inserting to squeeze through said bottom of said case and connecting with one of said alarm setting hands.

6. A time equipment, as recited in claim 5, in which said first hollow shaft has an angular protrusion extended circumstantially and outwardly therefrom, which provides a clipped-fit locking with said case for preventing said first hollow shaft from disengaging with said case.

7. A time equipment, as recited in claim 6, in which said second alarm setting wheel, located on said first alarm setting wheel, has a diameter smaller than that of said first alarm setting wheel and a second central hollow shaft which is longer than said first hollow shaft, said second hollow shaft being rotatably inserted through said first hollow shaft and connected with another said alarm setting hands.

8. A time equipment, as recited in claim 7, in which each of said alarm setting wheel has an edge recess formed at a free end thereof for firmly affixing said respective alarm setting hand.

9. A time equipment, as recited in claim 7, in which said motion plate has a through hole which periphery forms a top rim, and said pressing plate has a central opening, wherein said top rim is inserted into said central opening for holding said pressing plate in position, and two pivot arms being pivoted to a bracket formed in said case.

10. A time equipment, comprising a case;

a dial installed in said case comprising an hour portion, a minute portion and a period portion, in which said hour portion inscribing two sequences of numeral ordered by increasing value from 1 to 12 that said two sequences of numerals are arranged circularly spaced apart angularly, said first numeral "12" being inscribed in a top position of said hour portion, said second numeral "12" being inscribed in a bottom position of said hour portion, said two numerals "6" being inscribed in a right and a left position of said hour portion respectively, said minute portion being positioned adjacent to said hour portion and inscribing a sequence of numerals ordered by increasing value from 1 to 60 which are arranged circularly spaced apart angularly, wherein said numeral "60" is inscribed in a top position of said minute portion adjacent to said first numeral "12" of said hour portion, said numeral "30" being inscribed in a bottom position of said minute portion adjacent to said second numeral "12" of said hour portion, said period portion being positioned in a central area of said dial and encircled by said hour portion, in which said period portion has a central cross inscription having a vertical line extending from a top position to a bottom position of said period portion and a horizontal line extending from a left position to a right position of said period portion, so as to divide said period portion into a top-left section, a top-right section, a bottom-left section, and a bottom-right section for representing four different conditions of time, including a morning condition of time, an afternoon condition of time, an evening condition of time, and a night condition of time respectively, moreover, a "day"

mark being inscribed on a top part of said vertical line, a "night" mark being inscribed on a bottom part of said vertical line, an "a.m." mark being inscribed on a left part of said horizontal line, a "p.m." being inscribed on a right part of said horizontal line, a "MORNING" mark and an "AFTERNOON" mark being inscribed on a predetermined position of said top-left and top-right sections of said period portion respectively, an "EVENING" mark and a "NIGHT" mark being inscribed on a predetermined position of said bottom-right and bottom-left sections of said period portion;

an hour, a minute and a second indicating hands mounted for rotating above said dial;

a movement installed in said case to drive said hour indicating hand to rotate one revolution in 24 hours and to drive said minute and said second indicating hands to rotate one revolution in 60 minutes and 60 seconds respectively;

a time setting device installed in said case for setting said hour, minute and second indicating hands on time; and an alarm generating an alarm mechanism for providing more than one alarm signals at various predetermined times, an alarm time setting assembly for setting said predetermined alarm times, and a switch device for stopping said alarm signals, said alarm time setting assembly comprising at least two alarm setting wheels coaxially disposing layer upon layer on a bottom side of said case, each of said setting wheels having a shoulder rim recess with a predetermined width formed along a periphery thereof respectively; each said shoulder rim recess having a step protrusion with two inclined sides protruded thereon, each of said step protrusions having a height at least equal to a depth of said corresponding shoulder rim recesses respectively, each of said alarm setting wheels having a different diameter that said lower located alarm setting wheel has a diameter larger than that of said upper located alarm setting wheel;

at least two alarm setting hands which are mounted to said respective alarm setting wheels for rotating above said dial;

said movement comprising an hour indicating wheel coaxially placed above said alarm setting wheels for driving said hour indicating hand to rotate, said hour indicating wheel having at least two grooves formed therethrough and a diameter larger than that of said alarm setting wheels;

said alarm generating mechanism comprising an alarm generating circuit having a terminal contact and a conductive plate electrically disconnected with said terminal contact;

said alarm time setting assembly further comprising a motion plate, a pressing plate, and at least two setting gears of different diameters engaged with said corresponding alarm setting wheels respectively for driving said alarm setting wheels to rotate respectively by rotating said setting gears, so as to drive each said alarm setting wheel and each said alarm setting hand to rotate and preset a predetermined alarm time;

said motion plate, coaxially placed on said hour indicating wheel, having at least two projections, correspondingly and respectively aligned with said grooves of said hour indicating wheel, and extending downward from a bottom side of said motion plate, each of said projections having a different height and a slope side for inserting respectively through said corresponding groove of said hour indicating wheel and falling on said shoulder rim recess of said corresponding alarm setting wheel; and said pressing plate, disposed on said motion plate, having a projecting rod extended upwardly therefrom to a position abutting upon said conductive plate of said alarm generating mechanism; whereby said pressing plate is held in such a manner that said projecting rod hasn't contacted with said conductive plate, and thus when said hour indicating wheel rotates, said motion plate is also rotated concurrently; said alarm time setting assembly being so arranged that in one circulation, said projections of said motion plate being aligned only once with said corresponding step protrusions of said alarm setting wheels respectively, so that during rotating procedure, when one of said projections is aligned with said corresponding step protrusion, said respective projection climbs up said corresponding step protrusion, and thus said motion plate and said pressing plate being pressed to an incline position, so as to move said projection rod to press said conductive plate to in touch with said terminal contact for electrically connecting to generate an alarm signal.

11. A time equipment, as recited in claim 10, in which said switch device comprises a switch button device for stopping said alarm signal permanently, which comprises a button mounted on a rail means provided in said case for guiding said button to move in linear direction, a bottom side of said button having a stopping lever extending downward to a position adjacent to said conductive plate; whereby when said button is in an upper position, said lever is apart from said conductive plate of said alarm generating mechanism, and that when said button is pressed downwardly to a lower position, said stopping lever is move downwardly to press said conductive plate apart from said terminal contact and thus disconnecting the said alarm generating circuit permanently.

12. A time equipment, as recited in claim 11, in which said switch device further comprises a snooze device for stopping said alarm signal temporarily for a predetermined interval of time, after said predetermined time interval, said alarm generating mechanism generating another alarm signal again automatically; said snooze device comprising a contact switch, a delay circuit incorporating with said alarm generating circuit, and an electromagnetic means which has a lever extending downward and is electrically connected with said alarm generating circuit; whereby when said contact switch is press once during the alarm signal for actuating said electromagnetic means, said lever is pushed downward to press said conductive plate away from said terminal contact for a predetermined interval of time which is longer than the time period of said alarm signal generated, and that after said predetermined time interval, said electromagnetic means is actuated to pull back said lever to leave said conductive plate automatically, and thus said alarm generating mechanism is ready for generating another alarm signal again at the next preset alarm time.

13. A time equipment, as recited in claim 12, in which said first alarm setting wheel having the largest diameter is positioned at a bottom layer and has a first central hollow shaft extended from a bottom side thereof for inserting to squeeze through said bottom of said case and connecting with one of said alarm setting hands.

14. A time equipment, as recited in claim 13, in which said first hollow shaft has an angular protrusion extended circumstantially and outwardly therefrom, which provides a clipped-fit locking with said case for preventing said first hollow shaft from disengaging with said case, in which said second alarm setting wheel, located on said first alarm setting wheel, has a diameter smaller than that of said first alarm setting wheel and a second central hollow shaft which is longer than said first hollow shaft, said second hollow shaft being rotatably inserted through said first hollow shaft and connected with another said alarm setting hands, in which each of said alarm setting wheel has an edge recess formed at a free end thereof for firmly affixing said respective alarm setting hand, in which said motion plate has a through hole which periphery forms a top rim, and said pressing plate has a central opening, wherein said top rim is inserted into said central opening for holding said pressing plate in position, and two pivot arms being pivoted to a bracket formed in said case.

* * * * *